US006371027B1

(12) United States Patent
Hanke et al.

(10) Patent No.: US 6,371,027 B1
(45) Date of Patent: Apr. 16, 2002

(54) METHOD AND DEVICE FOR CLEANING CYLINDERS OF ROTARY PRINTING PRESSES

(75) Inventors: Bernd Hanke, Dresden; Gunnar Tschacher, Radebeul; Arndt Jentzsch, Coswig, all of (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/629,193

(22) Filed: Jul. 31, 2000

(30) Foreign Application Priority Data

Jul. 29, 1999 (DE) ..... 199 35 697

(51) Int. Cl.[7] ..... B41F 35/00
(52) U.S. Cl. ..... 101/483; 101/425
(58) Field of Search ..... 101/425, 424, 101/423, 483; 15/256.51, 256.52; 399/123, 357, 345

(56) References Cited

U.S. PATENT DOCUMENTS 4,612,446 A * 9/1986 Suzuki ..... 400/249
4,986,182 A * 1/1991 Sawaguchi et al. ..... 101/425
5,440,986 A * 8/1995 Braun ..... 101/423
5,479,857 A * 1/1996 Braun ..... 101/423
5,524,805 A * 6/1996 Shiba et al. ..... 226/108
5,727,470 A * 3/1998 Kurzer et al. ..... 101/423
5,927,205 A * 7/1999 Jentzsch ..... 101/423

FOREIGN PATENT DOCUMENTS

DE 3841269 12/1988
DE 4319258 6/1993
DE 19543518 11/1995
EP 0520521 A1 11/1988
JP 0008055 * 1/1990 ..... 101/425

* cited by examiner

*Primary Examiner*—John S. Hilten
*Assistant Examiner*—Anthony H. Nguyen
(74) *Attorney, Agent, or Firm*—Jones, Tullar & Cooper, PC

(57) ABSTRACT

A method for cleaning cylinders of rotary printing presses simplifies the changing of cleaning cloths. The exact effective length of the cleaning cloth available for the cleaning process can also be determined in the course of changing the cleaning cloth. A fresh supply roller carrying a fresh cleaning cloth 5 is inserted into the second cleaning cloth depot for replacing the soiled supply roll. The start of the cleaning cloth on the fresh supply roller is fixed in place on a spindle located in the first cleaning cloth depot and the fresh cleaning cloth is wound onto the spindle to form a fresh supply roll while determining the length of cloth wound on the spindle. The end of the fresh cleaning cloth remains in the second cleaning cloth depot and now forms the receiving roll during the cleaning process.

6 Claims, 2 Drawing Sheets

METHOD AND DEVICE FOR CLEANING CYLINDERS OF ROTARY PRINTING PRESSES

FIELD OF THE INVENTION

The present invention relates to a method for cleaning cylinders of rotary printing presses. A cleaning cloth is pulled off a supply roll located in a first receiving device, is pressed against the surface of the cylinder to be cleaned during the cleaning process by a pressing element, and is collected in a second receiving device in the form of a receiving roll. The supply roll is replaced by a fresh supply roll after the cleaning cloth on the supply roll has been used up and the full receiving roll is also removed. The present invention also relates to a device for cleaning cylinders of rotary printing presses. The device consists of a first cleaning cloth depot, to which a supply roll and a spindle are allocated, a second cleaning cloth depot, to which a receiving roll and a spindle are allocated, a pressure element for pressing a cleaning cloth against the cylinder to be cleaned, and a single drive motor, whose direction of rotation can be reversed, for driving both spindles.

BACKGROUND OF THE INVENTION

For replacing a used-up supply roll of a cleaning cloth in a printing press, it is customary to first remove the empty spindle of the supply roll from the cleaning device. A fresh cleaning cloth is then wound on the spindle and it is put back. The full receiving roll is removed, the soiled cleaning cloth is unwound from it, the empty spindle is again placed into the cleaning device and the beginning of the cleaning cloth is fixed in place on the now empty spindle.

There has been no lack of attempts to make this method more user-friendly. One prior solution is known from DE 38 41 269 A1, wherein the soiled cleaning cloth is wound back on the supply spindle, so that the supply roller can then be replaced by a fresh one. A single motor is provided for this purpose and which, depending on its direction of rotation, drives one or the other of the spindles.

A solution for rewinding the soiled cleaning cloth is known from EP 0 520 521 A1. Here, a drive motor is employed, which can be driven in one direction and which is connected with a transfer mechanism. This transfer mechanism is equipped for selectively coupling the motor with the rollers for rotation in the direction of rotation of the receiving roller; i.e. during cleaning operations or for rotation in the other direction, for rewinding the soiled cleaning cloth.

In the solution known from DE 43 19 258 A1, rewinding is avoided. In this prior art device, the cleaning device is designed in such a way that it can be rotated around its longitudinal axis by approximately 180°. The positions of both rolls can then be reversed after the cleaning cloth has been wound off the supply roll. The now empty supply roll is used for winding up the soiled cleaning cloth, i.e. as a receiving roll. The full receiving roll with the soiled cleaning cloth can then be removed and provides space for a fresh supply cloth.

A further solution for simplifying the changing of the cleaning cloth is known from DE 195 43 518 A1. The design of this prior device is such that the cleaning cloth of both rolls is wound on tubes, which in turn are seated on shafts seated laterally in the machine frame. Because of this, it is possible to remove the rollers from the machine transversely and parallel with the cylinder axis and in this way to replace the empty roller by a fresh one.

The limitations of the prior art devices include the fact that no exact information regarding the length of the cleaning cloth is available when placing such a fresh roll of cleaning cloth in the device. It is possible to determine the length of the cleaning cloth during the preparation of the roll, i.e. when winding the cleaning cloth onto the spindle. However, large deviations sometimes occur, which deviations are caused, in particular, by errors caused by the operators.

The determination and entry of cleaning cloth length values into a computer is also cumbersome, and furthermore the effective length sometimes changes considerably during the cleaning process because of cloth stretching and from other process-related effects. Therefore, an exact prediction of the time when the end of the cleaning cloth will be reached, and process values connected therewith, is not possible. Mechanical scanning of the diameter of the roll, such as is presently performed, as a rule is too inexact for sufficiently predicting the end of the cleaning cloth.

OBJECT AND SUMMARY OF THE INVENTION

It is the object of the present invention to provide a method and a device, by which the cleaning cloth change is simplified and with which it is possible, in the course of changing the cleaning cloths, to determine the exact effective length of the cleaning cloth available for the cleaning process with little effort.

This object is attained by the placement of a fresh supply roll of a cleaning cloth in a storage area for soiled cleaning cloths. The fresh cleaning cloth is wound off the soiled storage spindle onto a clean storage area spindle. During this winding, the length of the clean cloth is measured. An end of the fresh cleaning cloth stays in the soiled storage area and forms the start of the receiving roll of soiled cleaning cloth.

The advantage of the attainment of the object of the present invention lies in that the effective length of the cleaning cloth can now be accurately determined, so that data is made available for controlling the actual cleaning process, which makes it possible to automate this process. Moreover, the soiled cleaning cloth need not be rewound, so that no further soiling of the cleaning device occurs.

BRIEF DESCRIPTION OF THE DRAWINGS

The present invention will be explained in greater detail in what follows by way of a preferred embodiment, making reference to accompanying drawings, in which.

DETAILED DESCRIPTION OF THE PREFERRED EMBODIMENT

Figure 1:
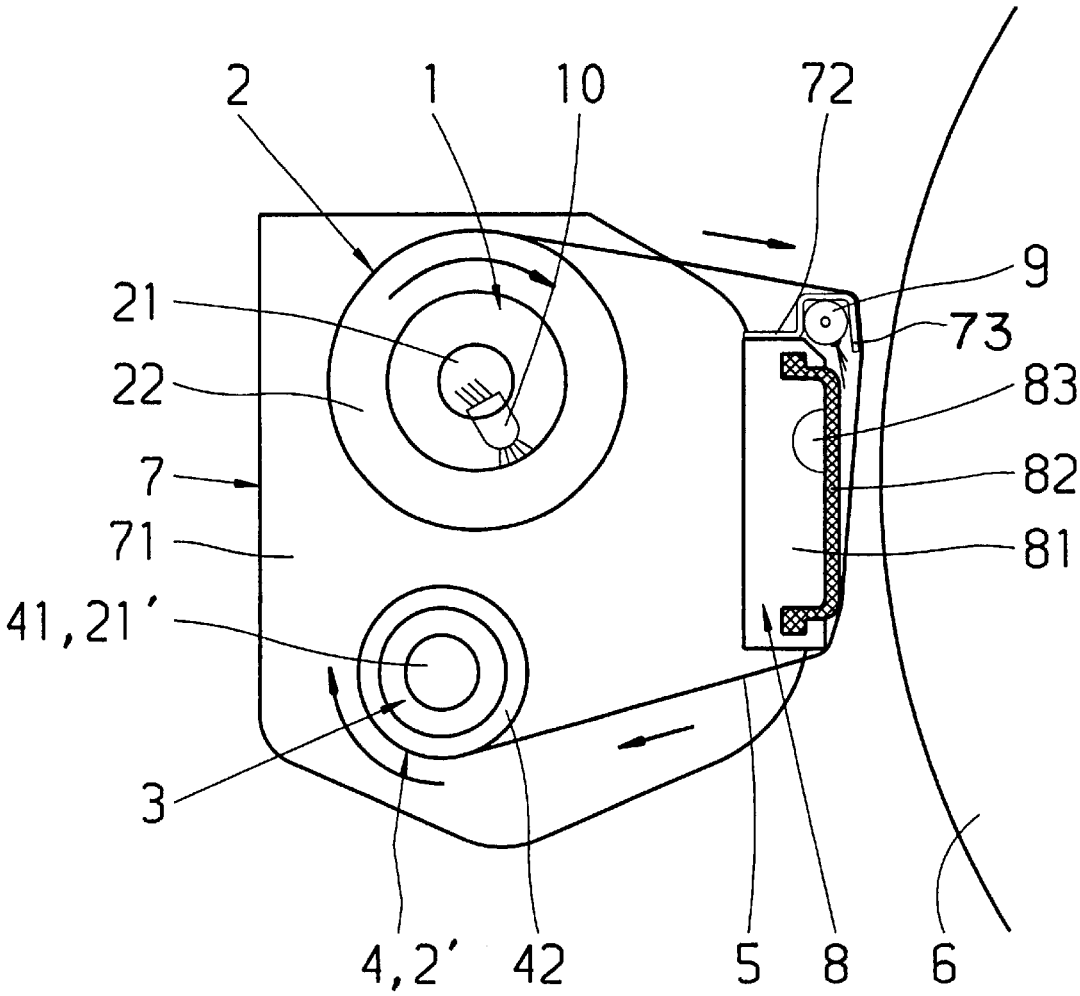
FIG. 1 is a schematic side elevation view of the cleaning device of the present invention.

Referring initially to FIG. 1, the cleaning device of the present invention essentially consists of a first cleaning cloth depot 1, a second cleaning cloth depot 3, and a cleaning cloth 5, which is pressed against the surface of a cylinder 6 to be cleaned by a pressure element, generally at 8.

The first cleaning cloth depot 1 will be understood to be an installation used for receiving a supply roller 2. Bearing and securing elements, not specifically represented, are also part of the cleaning cloth depot 1. The supply roller 2 consists of a spindle 21, on which a supply roll 22 of cleaning cloth 5 has been wound.

The second cleaning cloth depot 3 is designed analogously to the first cleaning cloth depot, but is used for receiving the cleaning cloth 5 which is pulled off the supply roller 2. The cleaning cloth 5 is wound to form a receiving roll 42 of cloth 5 on a spindle 41. The spindle 41 and the receiving roll 42 of cloth 5 constitute a receiving roller 4.

Figure 2:
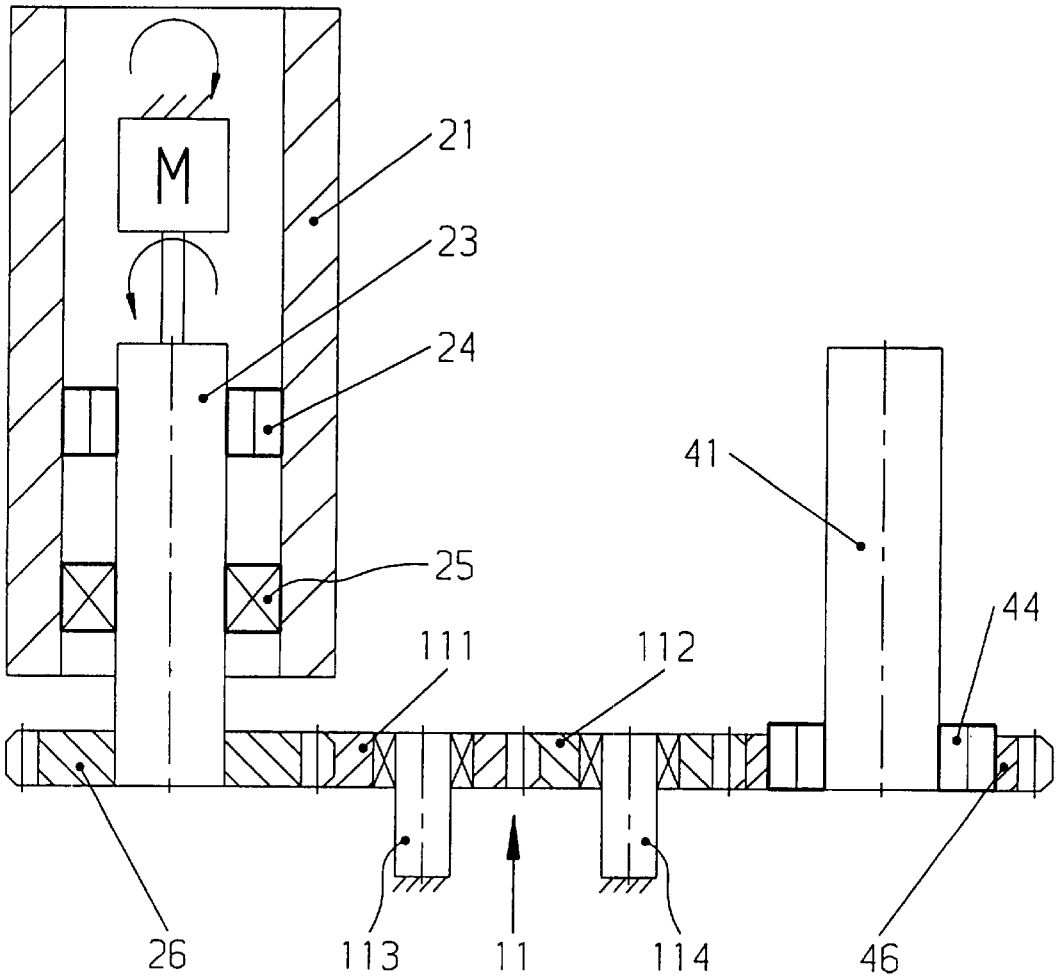
FIG. 2 is a schematic view of the drive mechanism of the device in accordance with the present invention.

The first cleaning cloth depot 1 is supported in a frame 7, as is the second cleaning cloth depot 3. The spindles 21, 41 are driven by a motor M, as shown in FIG. 2 as needed. The motor M is preferably arranged inside one of the two spindles 21, 41.

The frame 7 consists of lateral walls 71, in which the cleaning cloth depots 1, 3 are arranged.

A spray tube support 72, which supports a spray tube 9, is provided in the frame 7. The cleaning cloth 5 is conducted over the side of a pressure element 8 facing the cylinder 6. The pressure element 8 consists of a clamping element 81, in which a rubber diaphragm 82 is tightly clamped, and which can be charged with compressed air via an air supply 83.

A sensor 10 can be arranged inside one of the spindles 21, 41, or laterally on the frame 7.

As can be seen in FIG. 2, a drive motor M, whose direction of rotation is reversible, is seated inside the spindle 21. The drive motor M is connected to a. driveshaft 23, which is seated in the spindle 21 by rolling bearings 25 and a self-locking coaster device 24. The driveshaft 23 has a drive gear wheel 26 on its end facing away from the drive motor M.

The drive gear wheel 26 is connected, via a gear wheel train 11 consisting of gear wheels 111, 112, with a driven gear wheel 46, which is connected to the spindle 41 by means of a self-locking coaster device 44. The gear wheels 111, 112, are seated in the frame 7 of the cleaning device by shafts 113, 114.

The connection of the motor M to the spindle 21 is not compulsory. The drive motor M can be arranged in the same way inside the spindle 41 and can be connected to the spindle 21 in the manner as described above.

In the course of the cleaning process for cleaning the cylinder 6, the cleaning cloth 5 is pulled off the supply roll 22 of cloth 5 and is wound on the spindle 41 to form the receiving roll 42 of cloth 5. In the process, the cleaning cloth 5 is conducted over a cleaning cloth guide 73 and over the side of the pressure element 8 which faces the cylinder 6. Advancement of the cleaning cloth 5 can take place either in steps or continuously.

Compressed air can act on the pressure element 8, so that the rubber diaphragm 82 is displaced in the direction toward the cylinder 6 to be cleaned and presses the cleaning cloth 5 against the cylinder 6. The cleaning cloth 5 can be dampened by the spray tube 9.

Once the supply roll 22 of cloth 5 has been wound off, the trailing end of the cleaning cloth 5 is separated from the spindle 21, and the cleaning cloth 5 has been completely wound on the receiving roller 4. The latter is now removed from the second cleaning cloth depot 3. It is now possible to dispose of the receiving roller 4.

A fresh supply roller 2' of cloth 5 is inserted into the second cleaning cloth depot 3. The leading end of the cleaning cloth 5 on the fresh supply roller 2' is conducted over the side of the pressure element 8 facing the cylinder 6, and is fixed in place on the spindle 21 located in the first cleaning cloth depot 1. As a rule, this operation is performed manually. Now the cleaning cloth 5 is wound on the spindle 21 for forming a fresh supply roll 22 of the cloth 5. In the course of this process, the pressure element 8 is moved away from the cylinder 6, i.e. the cleaning cloth 5 has no contact with the surface of the cylinder 6. The winding process takes place at a speed that is a multiple of the draw-off speed of the cleaning cloth 5 which is customary during the cleaning process.

The winding-on process is performed because the drive motor M now rotates in the direction indicated by the left-facing arrow, as seen in FIG. 2. The coaster device 24 is blocked or locked in the course of this winding-on process so that the spindle 21 is driven and the driveshaft 23 is also driven. The movement of the driveshaft 23 is transferred to the driven gear wheel 46 via the drive gear wheel 26 and the gear wheel train 11. Since the coaster device 44 is unlocked, it does not seize in this movement direction, this movement is not transmitted to the spindle 41, so that the latter can freely rotate.

In the course of winding on the new supply roll 22 of cloth 5, the forward movement of the cleaning cloth 5 is detected by the sensor 10, and the data detected in this way is transmitted to a computer, not specifically represented here. The latter is now capable of determining the length of the cleaning cloth 5 on the supply roller 2. Together with machine data, for example the forward movement of the cleaning cloth 5 during the cleaning process, and with the job-specific data, a control of the cleaning process is therefore possible. A prediction of the end of the cleaning cloth 5 is now also possible.

The winding-on process of the cloth 5 onto the new supply roll 22 is continued until the end of the cleaning cloth 5 has been reached. It remains fixed in place on the spindle 21'. The cleaning device is therefore ready for operation.

In the course of operating the cleaning device of the present invention, the cleaning cloth 5 is pulled off the now filled supply roller 2. This takes place because the drive motor M now rotates in the direction indicated by the right-facing arrow in FIG. 2. In this direction of rotation, the coaster device 24 is not blocked or locked. This means that the rotating movement is not transmitted from the driveshaft 23 to the spindle 21. The drive gear wheel 26 transmits the movement via the gear wheel train 11 to the driven gear wheel 46. Via the coaster device 44 which seizes or locks in this direction, the driven gear wheel 46 drives the spindle 42, so that it can pull the cleaning cloth 5 off the new supply roll 22 of the cloth 5.

The principle of driving the two spindles 21, 41 is not limited to the above described embodiment with coaster devices 24, 44. In accordance with another embodiment, not specifically represented, it is also possible to design the drive mechanism for the two spindles 21, 41 in such a way that the selective switching of the drive mechanism is provided by controllable couplings.

While a preferred embodiment of a method and device for cleaning cylinders of rotary printing presses in accordance with the present invention has been set forth fully and completely hereinabove, it will be apparent to one of skill in the art that a number of changes in, for example, the type of cylinder to be cleaned, the type of cleaning cloth used, the specific motor and the like may be made without departing from the true spirit and scope of the present invention which is accordingly to be limited only by the following claims.

What is claimed is:

1. A method for cleaning a cylinder of a rotary printing press including:

providing a housing having a first cleaning cloth depot and a second cleaning cloth depot;

placing a supply roll of a cleaning cloth in said first cleaning cloth depot;

pulling said cleaning cloth off said supply roll and pressing said cleaning cloth against a surface of a cylinder to be cleaned;

collecting said now soiled cleaning cloth on a receiving roll in said second cleaning cloth depot and forming a full receiving roll of said soiled cleaning cloth;

removing said full receiving roll of said soiled cleaning cloth from said second cleaning cloth depot and replacing said full receiving roll of said soiled cleaning with a fresh roll of a fresh cleaning cloth;

directing a leading end of said fresh cleaning cloth to said first cleaning cloth depot;

transferring said fresh cleaning cloth to said first cleaning cloth depot;

forming a fresh supply roll of said transferred fresh cleaning cloth in said first cleaning cloth depot;

determining a length of said fresh cleaning cloth in said fresh supply roll during said transfer of said fresh cleaning cloth to said first cleaning cloth depot;

retaining a trailing end of said fresh cleaning cloth in said second cleaning cloth depot; and pulling said fresh cleaning cloth off said fresh supply roll for cleaning a surface of a cylinder.

2. The method of claim 1 further including providing a sensor for determining said length of said fresh cleaning cloth and supplying said length to a computer for evaluation.

3. The method of claim 2 further using said computer to receive data associated with the cylinder cleaning and using said data and said length of said fresh cleaning cloth and determining the amount of said cloth used and a remaining length of said cloth.

4. The method of claim 1 wherein advancement of said cleaning cloth takes place continuously.

5. The method of claim 1 wherein advancement of said cleaning cloth takes place in steps.

6. The method of claim 1 further including providing a spindle in said first cleaning cloth depot and manually attaching said leading end of said fresh cleaning cloth to said spindle.

* * * * *